US010520863B2

(12) United States Patent
Namisaki et al.

(10) Patent No.: US 10,520,863 B2
(45) Date of Patent: Dec. 31, 2019

(54) ROLLER DEVICE, FIXING DEVICE, AND IMAGE FORMING APPARATUS

(71) Applicant: SHARP KABUSHIKI KAISHA, Sakai, Osaka (JP)

(72) Inventors: Kousuke Namisaki, Sakai (JP); Kan Mukai, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/198,617

(22) Filed: Nov. 21, 2018

(65) Prior Publication Data

US 2019/0155196 A1 May 23, 2019

(30) Foreign Application Priority Data

Nov. 21, 2017 (JP) ..... 2017-223644

(51) Int. Cl.
*G03G 15/20* (2006.01)

(52) U.S. Cl.
CPC ..... *G03G 15/2025* (2013.01); *G03G 15/2032* (2013.01); *G03G 2215/2058* (2013.01)

(58) Field of Classification Search
CPC ..... G03G 15/2025; G03G 15/2032; G03G 15/2053; G03G 2215/2058; G03G 2215/2061
See application file for complete search history.

(56) References Cited

U.S. PATENT DOCUMENTS

| | | | | |
|---|---|---|---|---|
| 6,229,982 | B1 * | 5/2001 | Yamauchi | G03G 15/2025 118/60 |
| 8,886,097 | B2 * | 11/2014 | Nagata | G03G 15/2025 399/327 |
| 9,014,607 | B2 * | 4/2015 | Watanabe | G03G 15/2025 399/326 |
| 9,316,965 | B1 * | 4/2016 | Nakao | G03G 15/2025 |
| 2003/0223790 | A1 * | 12/2003 | Kawamoto | G03G 15/2025 399/327 |
| 2006/0034646 | A1 * | 2/2006 | Hiraoka | G03G 15/2025 399/327 |
| 2011/0229224 | A1 * | 9/2011 | Watanabe | G03G 15/2025 399/328 |
| 2014/0079452 | A1 * | 3/2014 | Arikawa | G03G 15/2025 399/327 |
| 2014/0294456 | A1 * | 10/2014 | Ueno | G03G 15/2025 399/327 |

FOREIGN PATENT DOCUMENTS

| | | | | |
|---|---|---|---|---|
| JP | 58117579 A | * | 7/1983 | G03G 15/2025 |
| JP | 2003-167456 A | | 6/2003 | |
| JP | 2013-050662 A | | 3/2013 | |

* cited by examiner

*Primary Examiner* — Sophia S Chen
(74) *Attorney, Agent, or Firm* — ScienBizi, P.C.

(57) ABSTRACT

The cleaning member is disposed to be opposite to the first roller with the second roller being provided therebetween. Compared to a case when the second roller is placed at a first position on a side of the first roller, if the second roller is placed at a second position on a side of the cleaning roller, a pressure between the second roller and the first roller becomes smaller, and a pressure between the second roller and the cleaning member becomes larger.

11 Claims, 13 Drawing Sheets

ROLLER DEVICE, FIXING DEVICE, AND IMAGE FORMING APPARATUS

BACKGROUND OF THE INVENTION

1. Field of the Invention

The present invention relates to a roller device, a fixing device, and an image forming apparatus such as a copying machine, a multifunction machine, a printer apparatus, or a facsimile apparatus.

2. Description of the Background Art

When a roller device that includes a first roller and a second roller swingable to change the pressure on the first roller is included in an image forming apparatus, for example, the roller device is used for a fixing device in which the first roller is a fixing roller and the second roller is a pressure roller.

In such a roller device, a surface of the second roller is usually contaminated by foreign matter such as paper dust and toner. For this reason, the roller device usually includes a cleaning member that contacts the second roller to clean the second roller.

In a conventional roller device including such a cleaning member, the cleaning member is always made to press-contact the second roller with a constant contact pressure. Consequently, if the surface of the second roller is not contaminated or less contaminated, the contact pressure of the cleaning member on the second roller is always constant and the life of the cleaning member is reduced accordingly.

Regarding this point, Japanese Patent Laying-Open No. 2003-167456 describes a configuration in which a tension roller (the first roller) and a backup roller (the second roller) are moved to be close to each other for the purpose of changing the contact pressure of a web (the cleaning member) disposed between the tension roller and the backup roller on the backup roller (see FIG. 4 in Japanese Patent Laying-Open No. 2003-167456). In addition, Japanese Patent Laying-Open No. 2013-50662 describes a configuration in which a web sheet is moved away from a pressure roller (a second roller) in response to the pressure roller moving away from a fixing roller (a first roller) (see FIGS. 2 and 3 in Japanese Patent Laying-Open No. 2013-50662).

SUMMARY OF THE INVENTION

In the configurations described in Patent Laying-Open Nos. 2003-167456 and 2013-50662, however, when a contact-pressure release operation is performed to release the contact pressure of a second roller on a first roller, a cleaning member cannot perform a cleaning operation.

The present invention has been achieved in view of the above problems, and an object of the invention is to provide a roller device that includes a first roller, a second roller swingable to change the pressure on the first roller, and a cleaning member which contacts the second roller to clean the second roller, that can improve the life of the cleaning member, and that enables the cleaning member to perform a cleaning operation when the second roller performs a contact-pressure release operation on the first roller and to provide a fixing device and an image forming apparatus.

To solve the problems, the present invention provides a roller device, a fixing device, and an image forming apparatus as follows.

(1) Roller Device

A roller device according to the present invention includes a first roller, a second roller that is swingable to change a pressure on the first roller, and a cleaning member that contacts the second roller to clean the second roller. The cleaning member is disposed to be opposite to the first roller with the second roller being provided between the cleaning member and the first member. When the second roller is placed at a first position on a side of the first roller, a pressure between the second roller and the first roller is a first roller pressure and a pressure between the second roller and the cleaning member is a first cleaning pressure. When the second roller is placed at a second position on a side of the cleaning roller, a pressure between the second roller and the first roller is a second roller pressure less than the first roller pressure, and a pressure between the second roller and the cleaning member is a second cleaning pressure larger than the first cleaning pressure.

(2) Fixing Device

A fixing device includes the roller device according to the present invention. The first roller is a fixing roller and the second roller is a pressure roller.

(3) Image Forming Apparatus

An image forming apparatus includes the roller device according to the present invention or the fixing device according to the present invention.

According to the present invention, the life of the cleaning member can be improved and when a contact-pressure release operation is performed to release the contact pressure of the second roller on first roller, the cleaning member can perform a cleaning operation.

DESCRIPTION OF THE PREFERRED EMBODIMENTS

Figure 1:
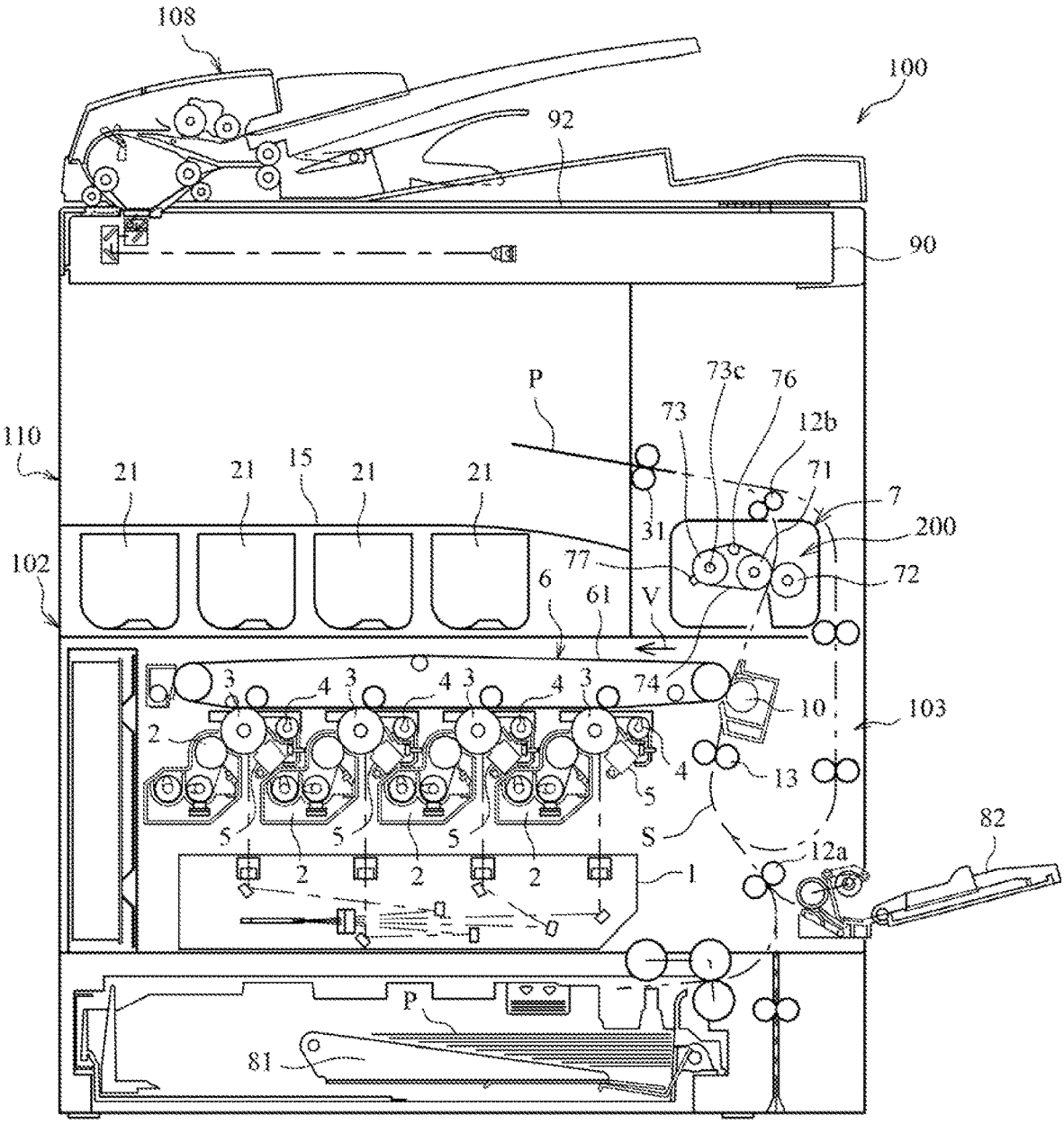
FIG. 1 is a schematic cross-sectional view of an image forming apparatus according to the present embodiment.

Embodiments of the present invention will be described below with reference to the drawings. In the following description, the same components will be designated by the same reference numerals and, further, have the same names and the same functions. Consequently, these components will not be repeatedly described in detail.

[Overall Configuration of Image Forming Apparatus]

FIG. 1 is a schematic cross-sectional view of an image forming apparatus 100 according to the present embodiment. The image forming apparatus 100 according to the present embodiment is a color image forming apparatus that forms a monochrome or multicolor image on a sheet P such as a recording sheet (specifically, a recording sheet) based on image data read by an image reader 90 or image data externally transmitted. The image forming apparatus 100 may be a monochrome image forming apparatus. Alternatively, the image forming apparatus 100 may be other color image forming apparatuses.

The image forming apparatus 100 includes a document feeder 108 and an image forming apparatus main body 110. The image forming apparatus main body 110 includes an image forming part 102 and a sheet transporting system 103.

The image forming part 102 includes an optical scanner 1, a plurality of development devices 2, a plurality of photosensitive drums 3 functioning as an electrostatic latent image carrier, a plurality of cleaning devices 4, a plurality of charging devices 5, an intermediate transfer belt device 6, a plurality of toner cartridge devices 21, and a fixing device 7. The sheet transporting system 103 includes a paper feed tray 81, a manual paper feed tray 82, and a discharge tray 15.

A document table 92 composed of a transparent glass, on which a document (not shown) is placed, is disposed on the image forming apparatus main body 110. The image reader 90 for reading images of the document is disposed under the document table 92. The document feeder 108 is disposed on the document table 92. An image of the document read by the image reader 90 is transmitted as image data to the image forming apparatus main body 110. An image formed based on the image data in the image forming apparatus main body 110 is recorded on a sheet P.

Image data handled by the image forming apparatus 100 is applicable to color images using a plurality of colors (in this example, black (K), cyan (C), magenta (M), and yellow (Y)). Consequently, the development device 2, the photosensitive drum 3, the cleaning device 4, the charging device 5, and the toner cartridge device 21 are respectively provided in plural (in this example, four for black, cyan, magenta, and yellow) so as to form a plurality types (in this example, four types of) images of the respective colors. In this way, a plurality of (in this example, four) image stations are configured.

When the image forming apparatus 100 forms images, a sheet P is supplied from the paper feed tray 81 or the manual paper feed tray 82 and transported to a registration roller 13 by a first transportation roller 12*a* disposed along a sheet transportation path S. Next, the sheet P is transported by a transfer roller 10 at a timing of registering toner images on an intermediate transfer belt 61 circulating in a circulation direction V in the intermediate transfer belt device 6 on the sheet P, so that the toner images are transferred to the sheet P. The sheet P then passes through a fixing roller 71 and a pressure roller 72 in the fixing device 7 for the purpose of thermally melting and fixing unfixed toner on the sheet P, and further passes through a second transportation roller 12*b* and a discharge roller 31 to be discharged on the discharge tray 15.

[Fixing Device]

The fixing device 7 is a fixing device with a belt fixing system. In the fixing device 7, a fixing belt 74 is entrained about a plurality of rollers (in this example, the fixing roller 71, a heating roller 73, and a tension roller 76). The fixing belt 74 transmits heat from the heating roller 73 to the fixing roller 71. The fixing device 7 is configured that the pressure roller 72 is pressed against the fixing roller 71 via the fixing belt 74.

In addition, the fixing belt 74 is heated by a heat source 73*c* disposed inside of the heating roller 73. The fixing belt 74 is configured to keep a predetermined fixing temperature based on a signal from a temperature detector 77. The fixing belt 74 thermally fixes multicolor toner images transferred to the sheet P on the sheet P with the pressure roller 72. The multicolor toner images thus melt, mix, and press-contact the sheet P to be thermally fixed on the sheet P. The temperature detector 77 is a temperature sensor that detects the surface temperature of the fixing belt 74 in a contact or noncontact manner, such as a thermistor.

Next, an example of using the roller device 200 according to the present embodiment for the fixing device 7 with a belt fixing system is described below.

Figure 2:
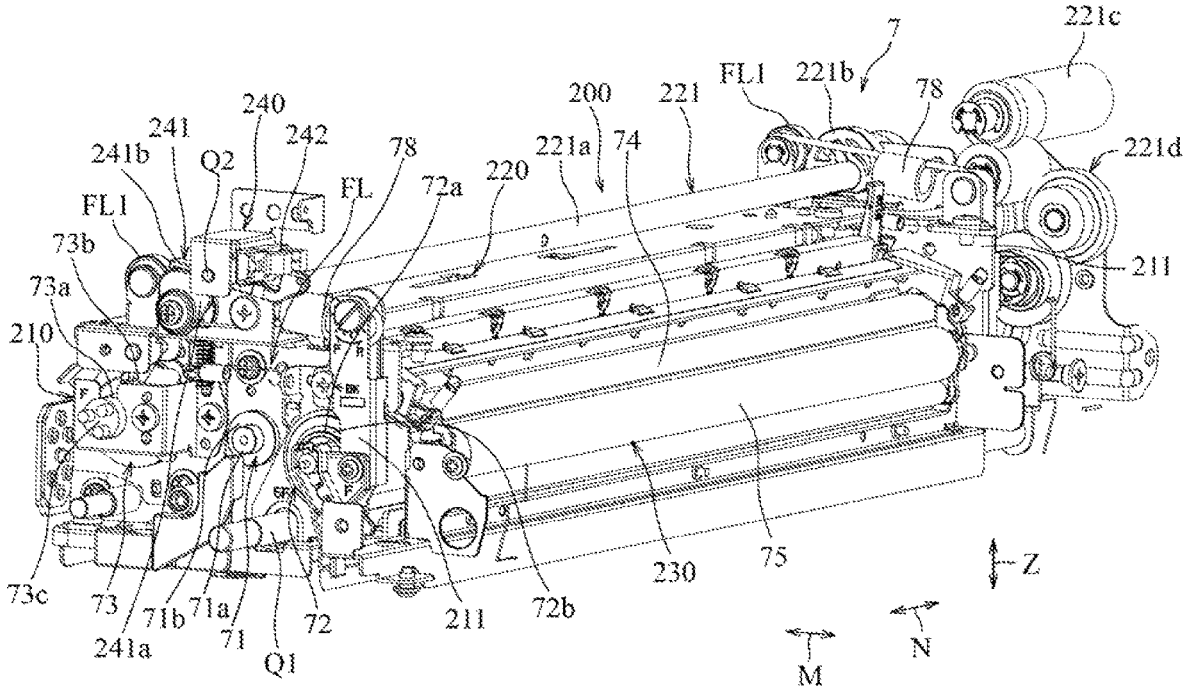
FIG. 2 is a perspective view of a schematic configuration of a fixing device shown in FIG. 1, as viewed from diagonally upper right on a front side.
Figure 3:
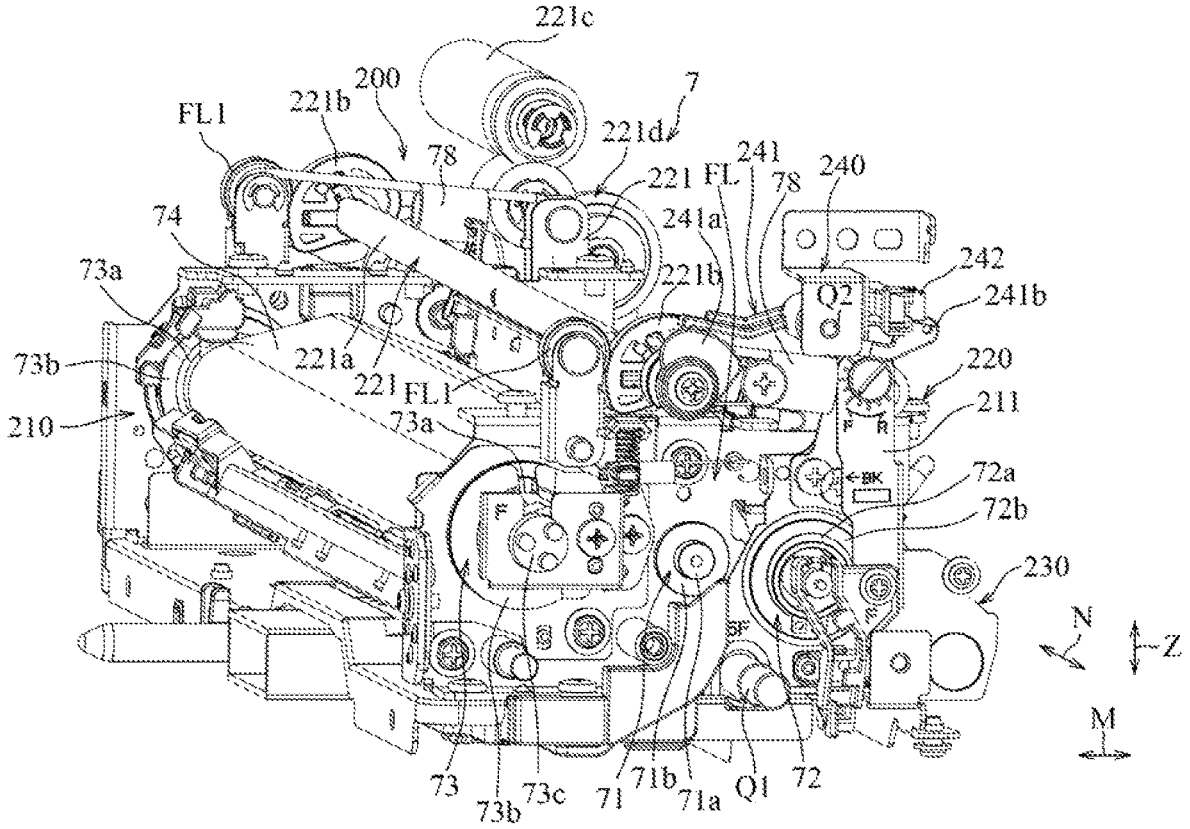
FIG. 3 is a perspective view of the schematic configuration of the fixing device shown in FIG. 1, as viewed from diagonally upper left on the front side.
Figure 4:
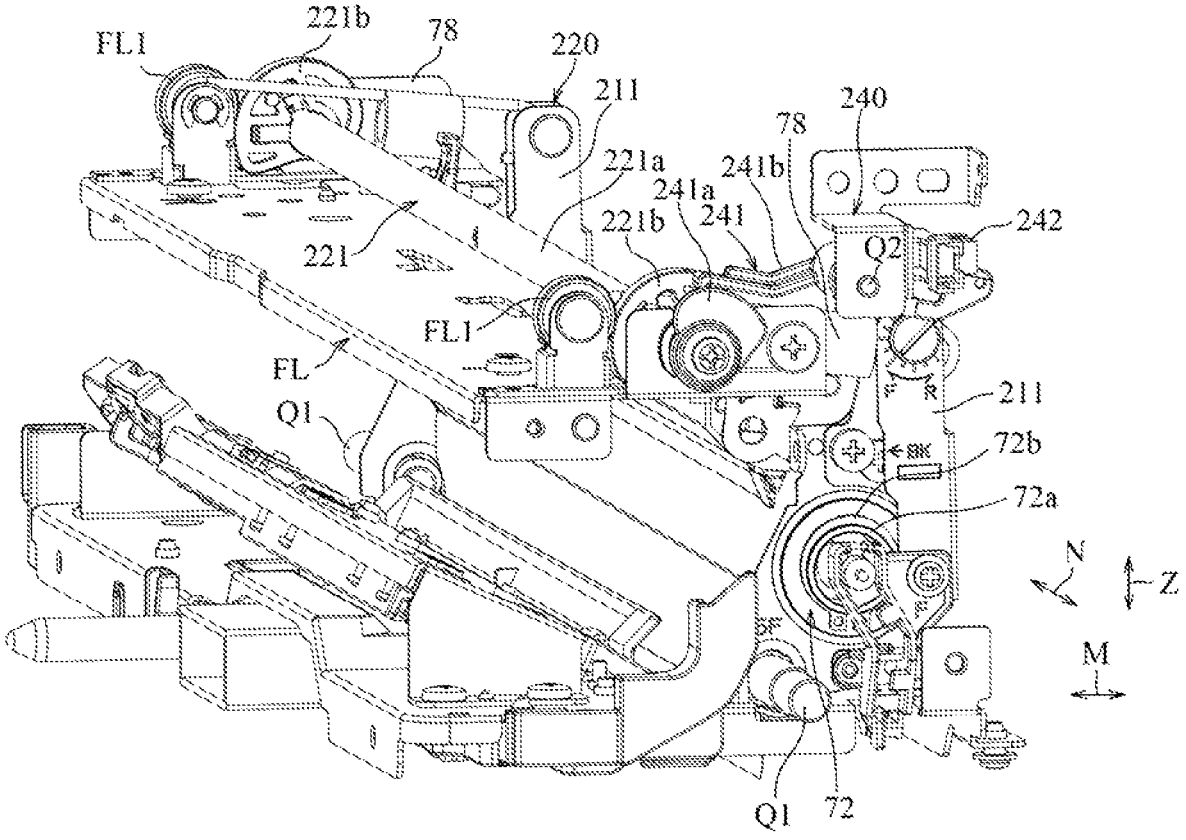
FIG. 4 is a perspective view of a press-contact unit in the fixing device shown in FIG. 1, as viewed from diagonally upper left on the front side.
Figure 5:
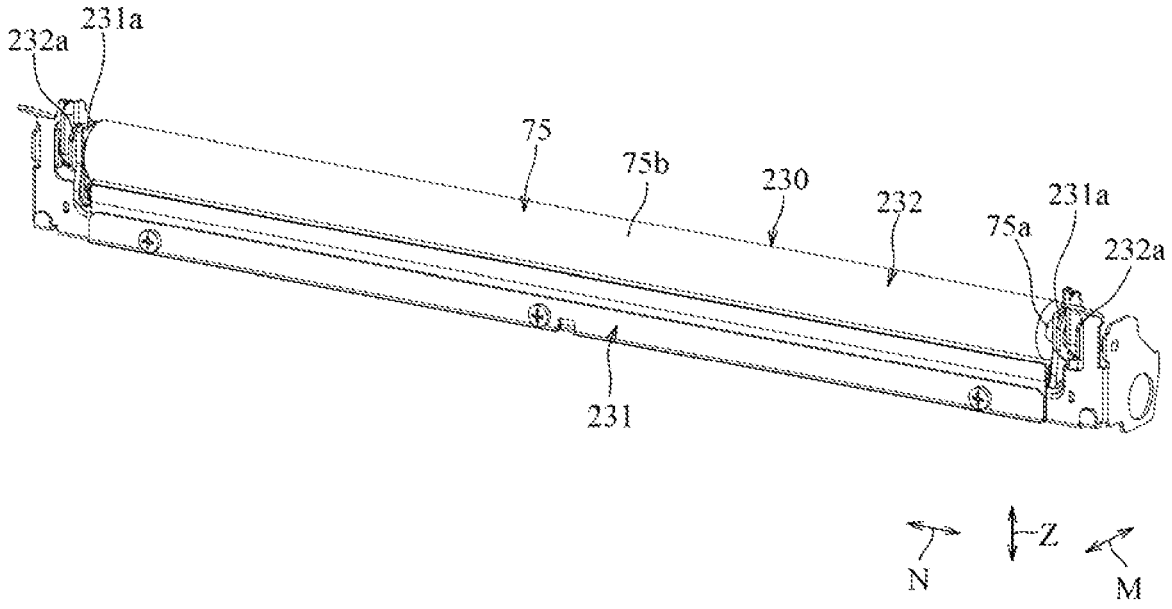
FIG. 5 is a perspective view of a cleaning unit as viewed from diagonally upper left on the front side.
Figure 6:
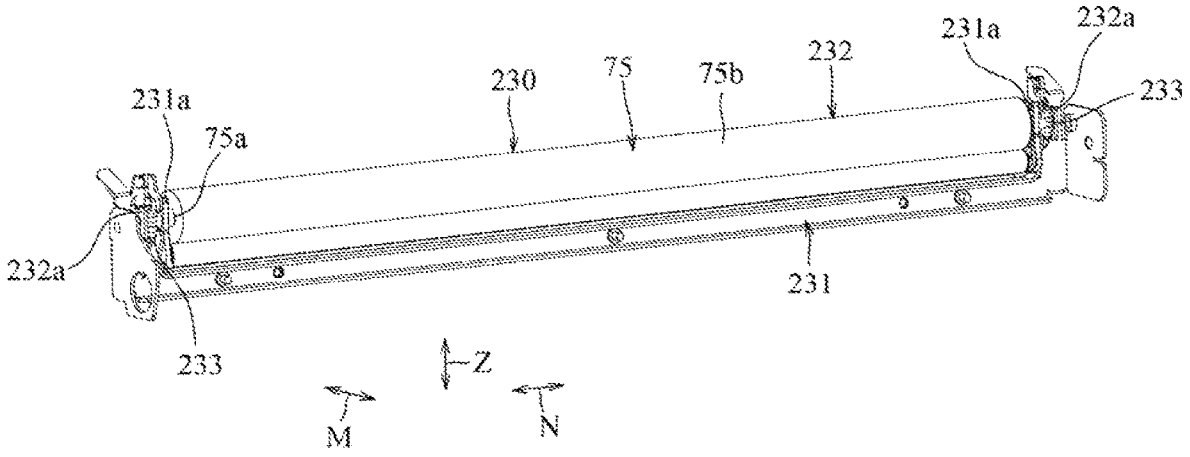
FIG. 6 is a perspective view of the cleaning unit as viewed from diagonally upper right on the front side.
Figure 7:
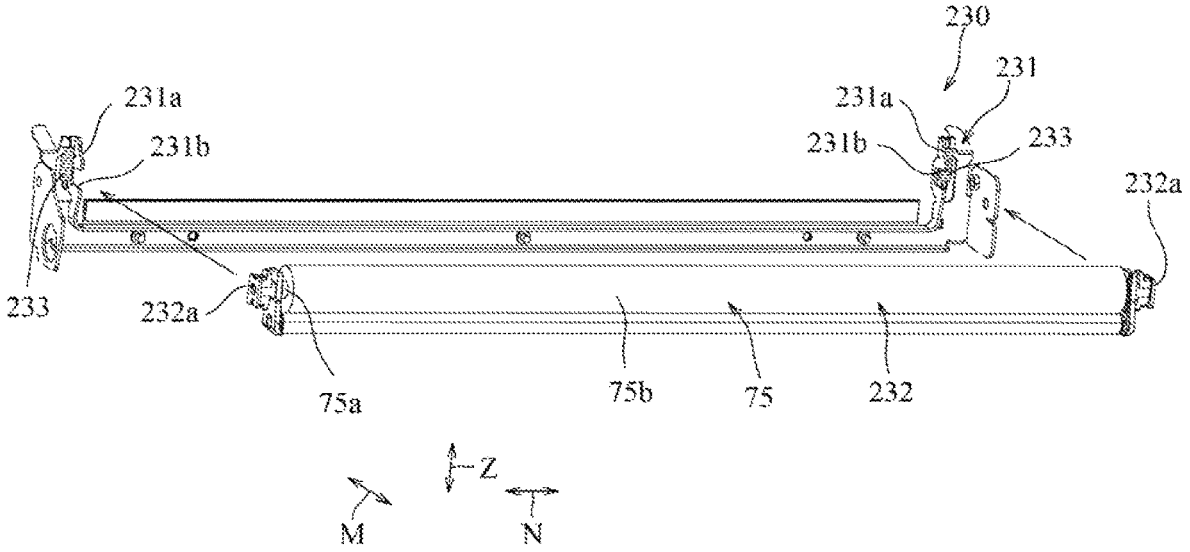
FIG. 7 is an exploded perspective view of the cleaning unit.
Figure 8:
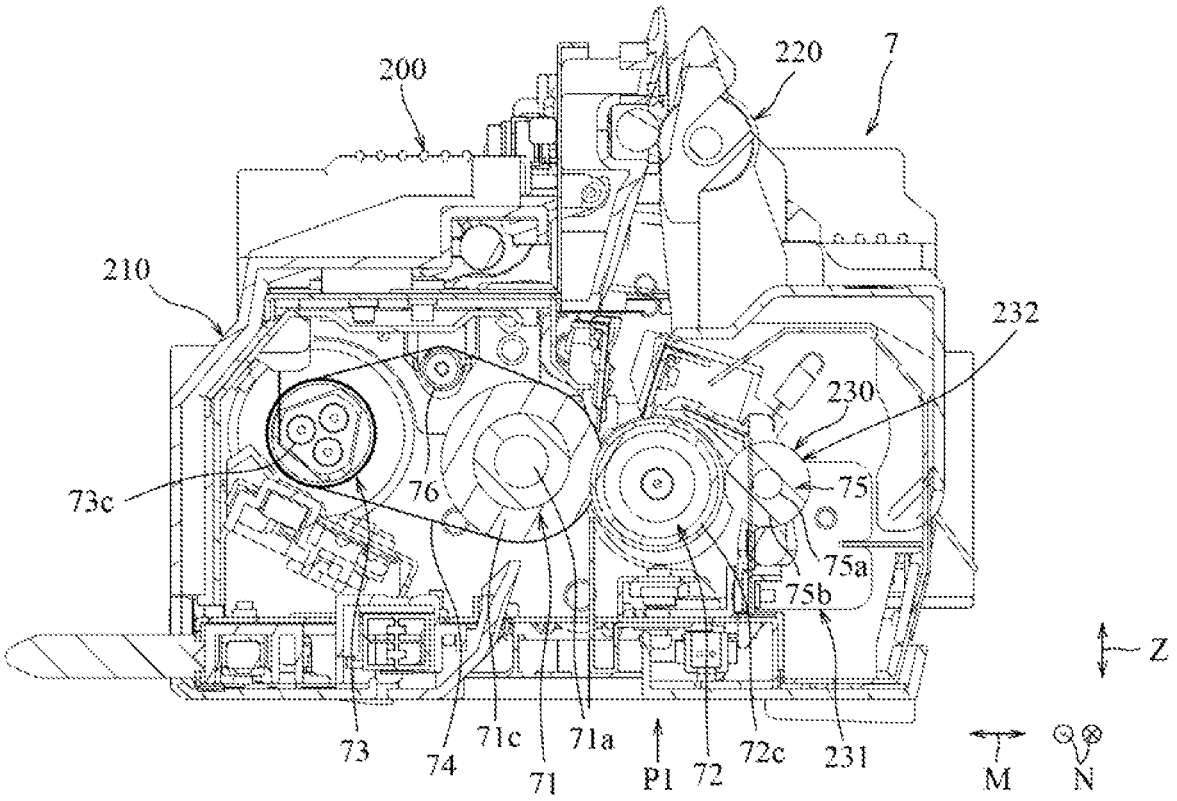
FIG. 8 is a longitudinal cross-sectional view of the fixing device, showing a state where a pressure roller is placed at a first position.
Figure 9:
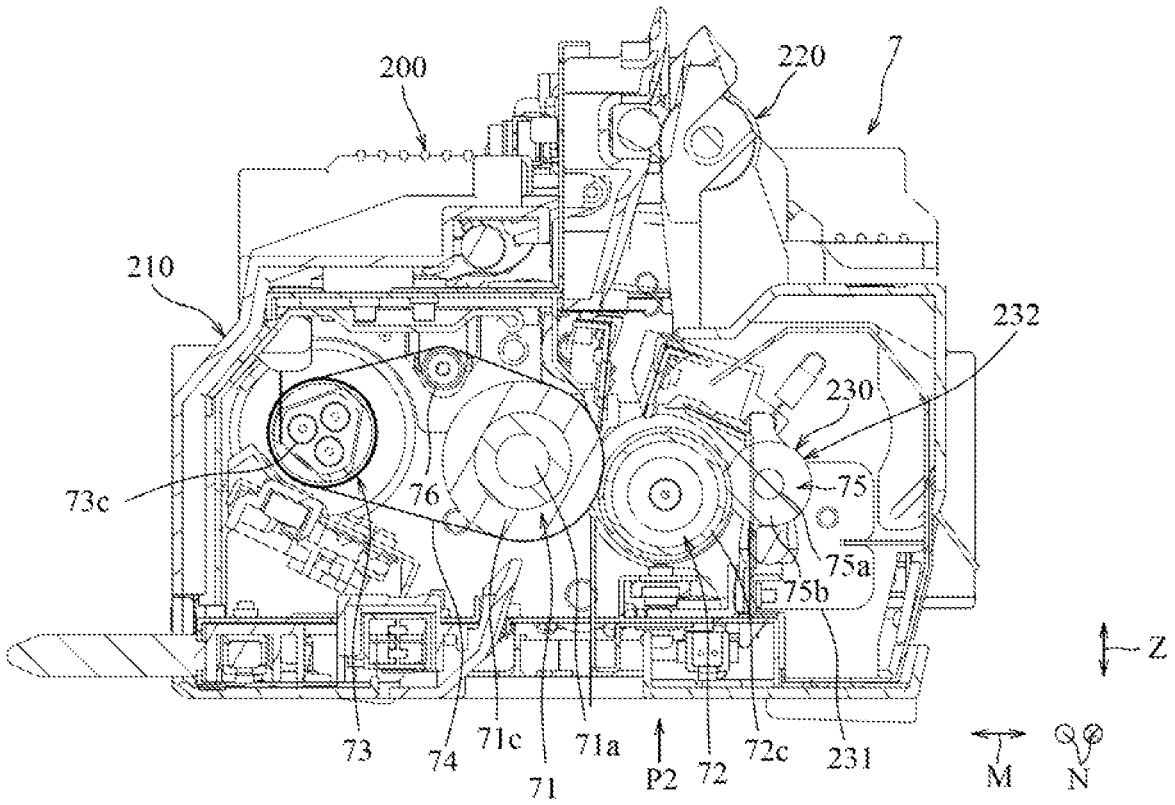
FIG. 9 is a longitudinal cross-sectional view of the fixing device, showing a state where the pressure roller is placed at a second position.

FIG. 2 is a perspective view of a schematic configuration of the fixing device 7 shown in FIG. 1, as viewed from diagonally upper right on the front side. FIG. 3 is a perspective view of the schematic configuration of the fixing device 7 shown in FIG. 1, as viewed from diagonally upper left on the front side. FIG. 4 is a perspective view of a press-contact unit 220 in the fixing device 7 shown in FIG. 1, as viewed from diagonally upper left on the front side. FIG. 5 is a perspective view of a cleaning unit 230 as viewed from diagonally upper left on the front side. FIG. 6 is a perspective view of the cleaning unit 230 as viewed from diagonally upper right on the front side. FIG. 7 is an exploded perspective view of the cleaning unit 230. FIGS. 8 and 9 are longitudinal cross-sectional views of the fixing device 7. FIG. 8 shows a state where the pressure roller 72 is placed at a first position P1 and FIG. 9 shows a state where the pressure roller 72 is placed at a second position P2.

In the present embodiment, the fixing device 7 includes a first roller (in this example, the fixing roller 71), a second roller (in this example, the pressure roller 72), and a cleaning member (in this example, a cleaning roller 75). The pressure roller 72 can swing to change the pressure on the fixing roller 71. The cleaning roller 75 contacts the pressure roller 72 to clean the pressure roller 72. The cleaning roller 75 is disposed to be opposite to the fixing roller 71 with the pressure roller 72 being provided therebetween.

The fixing device 7 further includes the endless fixing belt 74, an urging member (specifically, a press-contact spring 78), and a swing member 211. The fixing belt 74 is entrained about the fixing roller 71 and the heating roller 73. The swing member 211 is supported by a main body of the fixing device 7 (specifically, a main body frame FL) to be swingable around a swing axis (a swing shaft Q1) along a direction of a rotation axis of the pressure roller 72. The press-contact spring 78 press-contacts the pressure roller 72 against the fixing roller 71 with the fixing belt 74 being interposed between the pressure roller 72 and the fixing roller 71. A fixing nip is thus formed between the fixing belt 74 and the pressure roller 72. The press-contact spring 78 is connected to the main frame FL at one end and to the swing member 211 at the other end.

The fixing device 7 is constituted by a belt unit 210, a press-contact unit 220, and the cleaning unit 230.

The belt unit 210 includes the fixing roller 71, the heating roller 73, the fixing belt 74, and the tension roller 76. The fixing roller 71 is disposed in the main frame FL in a manner that a rotation shaft 71*a* is rotatable via a bearing 71*b*. The fixing roller 71 includes an elastic layer 71*c* (see FIGS. 8 and 9). The fixing roller 71 is driven to rotate through a drive transmission unit (not shown) by rotation drive force from a rotation drive part (not shown). The pressure roller 72 is disposed in the swing member 211 in a manner that a rotation shaft 72*a* is rotatable via a bearing 72*b*. The pressure roller 72 includes an elastic layer 72*c* (see FIGS. 8 and 9).

The heating roller 73 is disposed in the main body frame FL in a manner that a rotation shaft 73*a* is rotatable via a bearing 73*b*. The heating roller 73 includes the heat source 73*c* and heated by the heat source 73*c*. The fixing belt 74 can thus be heated through the heating roller 73. The tension roller 76 may be disposed outside the fixing belt 74.

The press-contact unit 220 functions as a unit that performs press-contact and pressure adjustments of the pressure roller 72 on the fixing roller 71, and press-contact release of the pressure roller 72 from the fixing roller 71.

The press-contact unit 220 includes a drive device 221. The drive device 221 swings the swing member 211 around the swing shaft Q1. The drive device 221 includes a rotation drive shaft 221*a*, an eccentric cam member 221*b*, a rotation drive part 221*c*, and a drive transmission mechanism 221*d*.

Drive force is transmitted from the rotation drive part 221*c* via the drive transmission mechanism 221*d* to the rotation drive shaft 221*a*. The eccentric cam member 221*b* is disposed on the rotation drive shaft 221*a* to contact a rotation member FL1 in the main body frame FL. The rotation drive part 221*c* is configured by a drive motor. The drive transmission mechanism 221*d* is configured by a gear train. The eccentric cam member 221*b* can rotate by rotation drive force transmitted from the rotation drive part 221*c* via the rotation drive shaft 221*a* and the drive transmission mechanism 221*d*. The eccentric cam member 221*b* can thus swing the pressure roller 72 that is supported by the swing member 211 against the press-contact spring 78 between the first position P1 about the swing shaft Q1 (see FIG. 8) and the second position P2 about the swing shaft Q1 (see FIG. 9). The first position P1 is on a side of the fixing roller 71 and the second position P2 is on a side of the cleaning roller.

The cleaning unit 230 is disposed to be removable from the main body frame FL. The cleaning unit 230 is disposed to be opposite to the belt unit 210 with the pressure roller 72 being interposed therebetween. The cleaning unit 230 includes a main body 231, a movable part 232, and an urging member (in this example, a press-contact spring 233).

The main body 231 supports the movable part 232 in a manner that the movable part 232 can move in a movement direction M along a radial direction of the pressure roller 72 (in a horizontal direction) on the opposite side to the belt unit 210. Unit support parts 231*a* are respectively disposed at both end portions of the main body 231 in a longitudinal direction N. The longitudinal direction N is along an axial direction of the cleaning roller 75. An engagement part 231*b* is formed in each of the unit support parts 231*a* (see FIG. 7). The engagement part 231*b* is recessed toward the pressure roller 72 in the movement direction M. Roller support parts 232*a* are respectively disposed at both end portions of the movable part 232 in the longitudinal direction N. The cleaning roller 75 is supported by the roller support parts 232*a* in a manner that the rotation shaft 75*a* is rotatable about a rotation axis. The rotation shaft 75*a* is composed of metal materials including, for example, stainless, SUM, iron, nickel, and aluminum. A cleaning member 75*b* is formed on an outer peripheral part of the rotation shaft 75*a*. The cleaning member 75*b* is composed of an elastic body, in this example, an elastic foam body (a sponge layer). The elastic foam body is not particularly limited, and commonly used foam materials may be used. Examples of the elastic foam body include foam bodies using organic rubbers including polyurethane, isoprene rubber (IR), nitrile rubber (NBR), ethylene propylene diene rubber (FPDM) or foam bodies using at least one of polyethylene, polyester resin, polypropylene, polyamide, polyurethane, and epoxy resin. The roller support part 232*a* engages with the engagement part 231*b* of the unit support part 231*a* so as to be movable in the movement direction M. The press-contact spring 233 urges the roller support part 232*a* toward the pressure roller 72. The press-contact spring 233 is connected to the unit support part 231*a* in a perpendicular direction Z (a vertical direction or a substantially vertical direction) perpendicular to the movement direction M and the longitudinal direction N to cover a side of the roller support part 232*a* opposite to a side at which the pressure roller 72 is disposed.

The pressure roller 72 and the heating roller 73 are rotated in response to rotation of the fixing roller 71. The cleaning roller 75 is rotated in response to rotation of the pressure roller 72.

(Control Unit)

Figure 10:
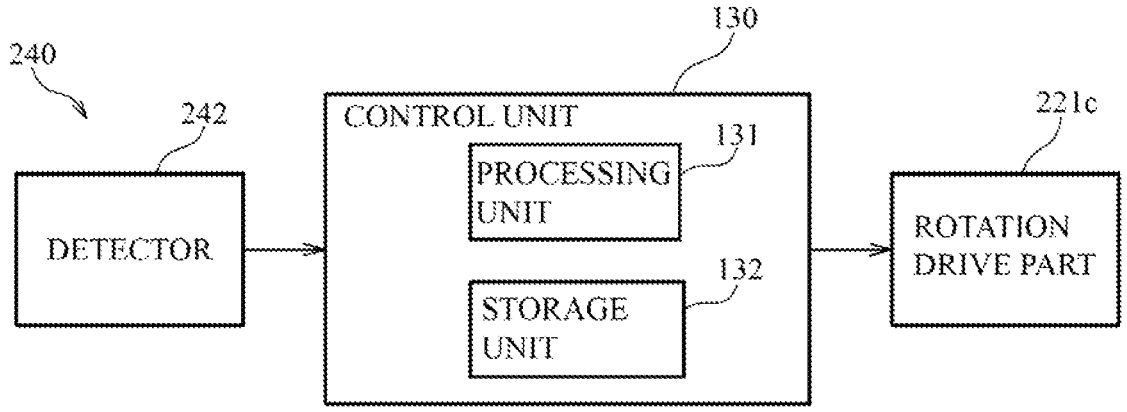
FIG. 10 is a system block diagram of a schematic configuration of a control system in the image forming apparatus according to the present embodiment.

FIG. 10 is a system block diagram of a schematic configuration of a control system in the image forming apparatus 100 according to the present embodiment.

As shown in FIG. 10, the image forming apparatus 100 further includes a control unit 130. The control unit 130 includes a processing unit 131 and a storage unit 132. The processing unit 131 is configured by a microcomputer such as a CPU. The storage unit 132 includes a nonvolatile memory such as a ROM and a volatile memory such as a RAM. The control unit 130 is configured to control operations of various constituent elements when the processing unit 131 loads a control program stored in advance in a ROM of the storage unit 132 into a RAM of the storage unit 132 and performs the program. The control unit 130 may be included in the fixing device 7.

Detection of Position of Pressure Roller

The fixing device 7 further includes a position detector 240 (see FIGS. 2 to 4 and FIG. 10). The position detector 240 includes a detected part 241 and a detector 242. The detected part 241 is constituted by an eccentric cam member 241*a* and an arm 241*b*. The eccentric cam member 241*a* is disposed at one end portion of the rotation drive shaft 221*a*. The arm 241*b* is supported by the main body frame FL to be rotatable about a rotation axis (a rotation shaft Q2) along the longitudinal direction N. One end portion of the arm 241*b* slide-contacts the eccentric cam member 241*a*. The arm 241*b* is rotated about the rotation shaft Q2 in response to rotation of the eccentric cam member 241*a*. The detector 242 detects the other end portion of the arm 241*b* by rotation of the arm 241*b* about the rotation shaft Q2. The detector 242 is a transmissive optical sensor. The detector 242 is electrically connected to an input system of the control unit 130. The control unit 130 can detect the home position (the original position) of the eccentric cam member 241*a* and then the home position of the pressure roller 72. The rotation drive part 221*c* is electrically connected to an output system of the control unit 130. The control unit 130 can thus control an operation of the rotation drive part 221*c*.

Swing Operation of Pressure Roller

The control unit 130 outputs an operation signal indicating the rotational position (the rotation angle) of the eccentric cam member 241*a* determined by using the home position (the original position) of the eccentric cam member 241*a* as a reference to the rotation drive part 221*c*. The control unit 130 can rotate the eccentric cam member 241*a* via the rotation drive shaft 221*a* by the rotation drive unit 221*c*. Consequently, it is possible to perform press-contact and pressure adjustments of the pressure roller 72 on the fixing roller 71 and press-contact release of the pressure roller 72 from the fixing roller 71.

First Embodiment

In the present embodiment, when the pressure roller 72 is placed at the first position P1, the pressure between the pressure roller 72 and the fixing roller 71 is a first roller pressure. At this time, a cleaning operation is performed in a state where the pressure between the pressure roller 72 and the cleaning roller 75 is a first cleaning pressure. Meanwhile, when the pressure roller 72 is placed at the second position P2, the pressure between the pressure roller 72 and the fixing roller 71 is a second roller pressure less than the first roller pressure. At this time, the cleaning operation is performed in a state where the pressure between the pressure roller 72 and the cleaning roller 75 is a second cleaning pressure larger than the first cleaning pressure. Consequently, when the pressure roller 72 is placed at the first position P1, the pressure between the pressure roller 72 and the cleaning roller 75 is the first cleaning pressure less than the second cleaning pressure. The life of the cleaning roller 75 can thus be improved. In addition, even when the pressure roller 72 is placed at the second position P2, the cleaning roller 75 can perform the cleaning operation. Consequently, if a contact-pressure release operation is performed to release the pressure of the pressure roller 72 on the fixing roller 71, the cleaning roller 75 can perform the cleaning operation.

As the contact pressure between the cleaning roller 75 and the pressure roller 72 is increased, the cleaning performance of the cleaning roller 75 is improved. When the contact pressure between the cleaning roller 75 and the pressure roller 72 is too large, however, foreign matter adhered to the cleaning roller 75 by the cleaning operation may return to the pressure roller 72. When the cleaning operation is performed during an image forming operation, the foreign matter may affect images.

Regarding this point, the image forming operation can be performed when the pressure roller 72 is placed at the first position P1 in the present embodiment. The image forming operation can be performed when the contact pressure between the cleaning roller 75 and the pressure roller 72 is small. Consequently, when the cleaning operation is performed during the image forming operation, it is possible to prevent the foreign matter adhered to the cleaning roller 75 by the cleaning operation from returning to the pressure roller 72. It is thus possible to prevent the foreign matter from affecting images. In addition, it may be configured that the image forming operation is not performed when the pressure roller 72 is placed at the second position P2. Consequently, the image forming operation is not performed when the contact pressure between the cleaning roller 75 and the pressure roller 72 is large. The cleaning performance of the cleaning roller 75 can thus be more improved than that during the image forming operation. If the foreign matter adhered to the cleaning roller 75 by the cleaning operation returns to the pressure roller 72, the image forming operation is not performed and thus influence of the foreign matter on images is not particularly problematic.

Magnitude relationships between the first roller pressure, the second roller pressure, the second cleaning pressure, and the first cleaning pressure are as follows.

The first roller pressure may be larger than the second cleaning pressure and the second cleaning pressure may be larger than the second roller pressure. In this case, the second roller pressure may be larger than the first cleaning pressure or may be equal to the first cleaning pressure (first roller pressure>second cleaning pressure>second roller pressure>first cleaning pressure).

Alternatively, the first roller pressure may be larger than the second cleaning pressure and the second cleaning pressure may be larger than the first cleaning pressure. In this case, the first cleaning pressure may be larger than the second roller pressure (including a case where no pressure is applied) (first roller pressure>second cleaning pressure>first cleaning pressure>second roller pressure).

Alternatively, the first roller pressure may be larger than the second cleaning pressure and the second cleaning pressure may be equal to the second roller pressure. In this case, the second roller pressure may be larger than the first cleaning pressure (first roller pressure>second cleaning pressure=second roller pressure>first cleaning pressure).

Alternatively, the first roller pressure may be larger than the second roller pressure and the second roller pressure may be larger than the second cleaning pressure. In this case, the second cleaning pressure may be larger than the first cleaning pressure (first roller pressure>second roller pressure>second cleaning pressure>first cleaning pressure).

The contact pressure between the cleaning roller 75 and the pressure roller 72 can be changed in the present embodiment. The contact pressure between the cleaning roller 75 and the pressure roller 72 can thus be changed according to contamination on a surface of the pressure roller 72. The degree to which the cleaning roller 75 cleans the pressure roller 72 can thus be adjusted. That is, when the surface of the pressure roller 72 is less contaminated, the contact pressure between the cleaning roller 75 and the pressure roller 72 is less than that when the surface of the pressure roller 72 is contaminated. It is thus possible to prevent a reduction in the life of the cleaning roller 75. Such an adjustment is preferably performed when the pressure roller 72 is placed at the second position P2.

The cleaning roller 75 is urged toward the pressure roller 72 by the press-contact spring 78 in the present embodiment. The contact pressure between the cleaning roller 75 and the pressure roller 72 can thus be increased. It is thus possible to further improve the cleaning performance of the cleaning roller 75.

The pressure roller 72 may be formed in a manner that its outer diameter is gradually increased from a center portion of the pressure roller 72 in the longitudinal direction N toward an outer end portion thereof (formed in an inverted crown shape). In this case, when the outer diameter of the cleaning roller 75 is constant or substantially constant in the longitudinal direction N, the contact pressure between the cleaning roller 75 and the pressure roller 72 is not uniform in the longitudinal direction N. Consequently, the cleaning performance of the cleaning roller 75 may vary in the longitudinal direction N.

Regarding this point, when the pressure roller 72 is formed in an inverted crown shape, the cleaning roller 75 is formed in a manner that its outer diameter is gradually reduced from a center portion of the cleaning roller 75 in the longitudinal direction N toward an outer end portion thereof (formed in a crown shape) according to the shape of the pressure roller 72. The contact pressure between the cleaning roller 75 and the pressure roller 72 can thus be uniform in the longitudinal direction N of the pressure roller 72. Consequently, the cleaning performance of the cleaning roller 75 is constant or substantially constant in the longitudinal direction N.

It is configured in the present embodiment that the pressure roller 72 steplessly swings relative to the fixing roller 71 by a cam mechanism. The contact pressure between the cleaning roller 75 and the pressure roller 72 can thus be changed steplessly. The contact pressure between the cleaning roller 75 and the pressure roller 72 can be steplessly changed depending on contamination on the surface of the pressure roller 72. The degree to which the cleaning roller 75 cleans the pressure roller 72 can be adjusted steplessly. In addition, the contact pressure between the pressure roller 72 and the fixing roller 71 (the fixing belt 74) can be steplessly changed. The contact pressure between the pressure roller 72 and the fixing roller 71 can be steplessly changed depending on the degree of toner fixing. In this example, the control unit 130 is configured to adjust the degree of cleaning and/or the degree of fixing through an input screen displayed on a display unit (not shown) in an operation unit (not shown) in a simulation mode. On the input screen, values of the contact pressure between the cleaning roller 75 and the pressure roller 72 when the pressure roller 72 is placed at the second position P2 and/or values of the contact pressure between the pressure roller 72 and the fixing roller 71 when the pressure roller 72 is placed at the first position P1 can be input.

The fixing belt 74 is entrained about the fixing roller 71 in the present embodiment. In this manner, the configuration of the present embodiment can be applied to a fixing device of a fixing belt type.

Second Embodiment

In the present embodiment, during an image forming operation, the control unit 130 drives the fixing device 7 to rotate the fixing roller 71 in the same direction as the rotation direction of the fixing roller 71 during the image forming operation while the pressure roller 72 is placed at the first position P1. The control unit 130 performs, for a predetermined first period T1, a first drive operation of driving the fixing device 7 to rotate the fixing roller 71 in the same direction as the rotation direction of the fixing roller 71 during the image forming operation while the pressure roller 72 is placed at the first position P1. In addition, the control unit 130 performs, for a predetermined second period T2, a second drive operation of driving the fixing device 7 to rotate the fixing roller 71 in the same direction as the rotation direction of the fixing roller 71 during the mage forming operation while the pressure roller 72 is placed at the second position P2. The first drive operation is thus continuously shifted to the second drive operation before or after the image forming operation.

Figure 11:
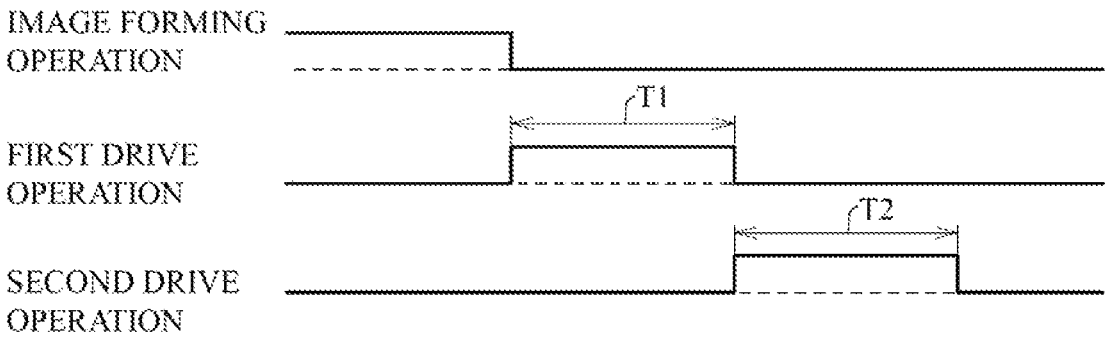
FIG. 11 is a timing chart of an example of a drive operation of the fixing device.

FIG. 11 is a timing chart of an example of a drive operation of the fixing device 7. In an example of FIG. 11, the control unit 130 performs a first drive operation for a first period T1 (for example, for one minute) immediately after an image forming operation and then performs a second drive operation for a second period T2 (for example, for one minute) immediately after the first drive operation. The image forming operation can thus be smoothly shifted to the first drive operation without switching the position of the pressure roller 72.

Figure 12:
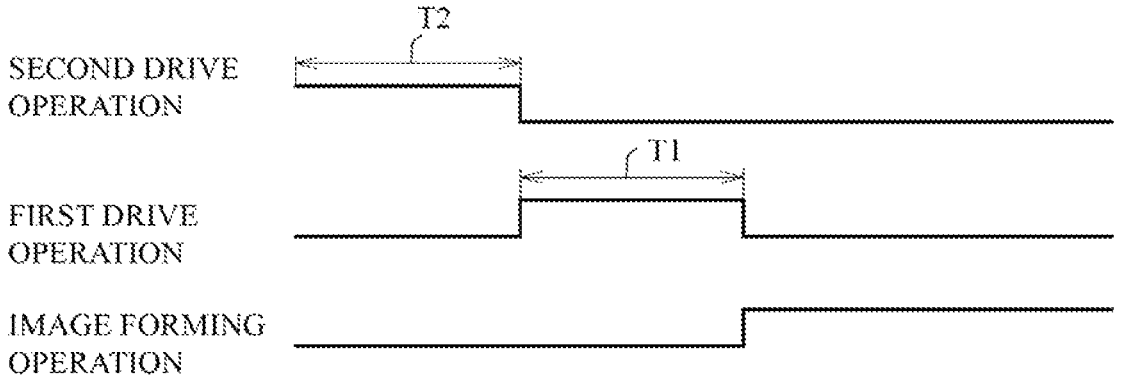
FIG. 12 is a timing chart of another example of the drive operation of the fixing device.

FIG. 12 is a timing chart of another example of the drive operation of the fixing device 7. In an example of FIG. 12, in addition to the configuration shown in FIG. 11 or instead of that, the control unit 130 performs a second drive operation for a second period T2 (for example, ten seconds) at the time of start-up of the image forming apparatus 100 and then performs a first drive operation for a first period T1 (for example, ten seconds) immediately after the second drive operation. When receiving an instruction to perform an image forming operation, the control unit 130 performs the image forming operation. The first drive operation can thus be smoothly shifted to the image forming operation without switching the position of the pressure roller 72.

Third Embodiment

In the present embodiment, the control unit 130 performs a third drive operation of driving the fixing device 7 to rotate the pressure roller 72 in the opposite direction to the rotation direction of the pressure roller 72 during an image forming operation while the pressure roller 72 is placed at the second position P2. The pressure roller 72 can thus rotate in the opposite direction to the rotation direction of the pressure roller 72 during the image forming operation. The cleaning performance of the cleaning roller 75 can thus be further improved.

Figure 13:
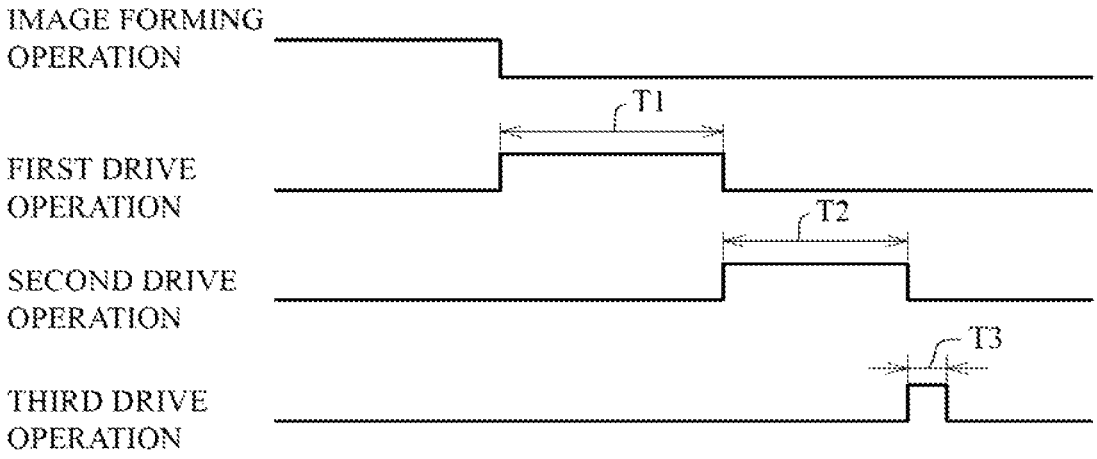
FIG. 13 is a timing chart of yet another example of the drive operation of the fixing device.

FIG. 13 is a timing chart of yet another example of the drive operation of the fixing device 7. In an example of FIG. 13, the control unit 130 performs a first drive operation for a first period T1 (for example, for one minute) immediately after the image forming operation, then performs a second drive operation for a second period T2 (for example, for 50 seconds) immediately after the first drive operation, and performs a third drive operation for a third period T3 (for example for ten seconds) immediately after the second drive operation. The pressure roller 72 can thus rotate in the opposite direction to the rotation direction of the pressure roller 72 during the image forming operation without switching the position of the pressure roller 72. The cleaning performance of the cleaning roller 75 can thus be further improved.

In the second drive operation shown in FIG. 11 and the second and third drive operations shown in FIG. 13, the fixing device 7 is driven in a state where heating of the heating roller 73 is stopped. The fixing roller 71, the pressure roller 72, the heating roller 73, the fixing belt 74, and the like can thus be uniformly cooled.

Other Embodiments

While the cleaning member is a cleaning roller in the present embodiment, the cleaning member may be a cleaning web or a cleaning pad.

While the roller device is used for a fixing device with a belt fixing system in the present embodiment, the roller device may be used for a fixing device without a belt. In addition, while the roller device is used for a fixing device, the roller device may be used for a transportation device that transports sheets in an image forming apparatus.

The present invention is not limited to the embodiments described above, and may be implemented in other various forms. These embodiments are only illustrative in all aspects, not restrictive. The scope of the present invention is defined by the appended claims and is not restricted by the specification. Modifications and changes falling within the equivalent scope of the claims are all included in the scope of the present invention.

What is claimed is:

1. A fixing device comprising:

a first roller;

a second roller that is provided in contact with the first roller;

a cleaning member that is provided in contact with the second roller to clean the second roller;

a driver that drives the second roller swingingly relative to the first roller; and a controller that controls the driver, wherein the controller controls the driver to drive swingingly the second roller relative to the first roller so as to change a pressure between the second roller and the first roller and a pressure between the second roller and the cleaning member to a predetermined relationship in accordance with a position to which the second roller is driven swingingly, wherein the predetermined relationship according to the position to which the second roller is driven swingingly in such that when the second roller is driven swingingly to a first position on a side of the first roller, the pressure between the second roller and the first roller is a first roller pressure and the pressure between the second roller and the cleaning member is a first cleaning pressure, and when the second roller is driven swingingly to a second position on a side of the cleaning member, the pressure between the second roller and the first roller is a second roller pressure less than the first roller pressure, and the pressure between the second roller and the cleaning member is a second cleaning pressure larger than the first cleaning pressure.

2. The fixing device according to claim 1, further comprising a position detector that detects a position of the second roller, wherein the controller controls the driver in accordance with a detection result of the position detector, and the cleaning member is provided with being urged on the second roller.

3. The fixing device according to claim 1, wherein the driver is configured to drive the second roller to steplessly swing relative to the first roller.

4. The fixing device according to claim 1, wherein the first roller is a fixing roller and the second roller is a pressure roller.

5. The fixing device according to claim 4, wherein a fixing belt is entrained about a fixing roller.

6. The fixing device according to claim 1, wherein the driver is configured to drive the first roller to rotate, and the controller is configured to control the driver to perform a first drive operation in a first period to rotate the first roller in a same direction as a rotation direction in which the first roller is rotated during an image forming operation while the second roller is placed at the first position, and perform a second drive operation in a second period to rotate the first roller in the same direction as the rotation direction in which the first roller is rotated during the image forming operation while the second roller is placed at the second position.

7. The fixing device according to claim 6, wherein the controller performs the first drive operation after an image forming operation and performs the second drive operation after the first drive operation.

8. The fixing device according to claim 7, wherein the controller further performs a third drive operation in a third period to rotate the second roller in a direction opposite to a rotation direction in which the second roller is rotated during an image forming operation while the second roller is placed at the second position.

9. The fixing device according to claim 8, wherein the controller performs the third drive operation after the second drive operation.

10. An image forming apparatus comprising the fixing device according to claim 1.

11. A control method of a fixing device that includes a first roller, a second roller that is provided in contact with the first roller, and a cleaning member that is provided in contact with the second roller to clean the second roller, the member comprising:

driving the first roller to rotate and driving the second roller swingingly relative to the first roller by a driver; and controlling the driver to drive swingingly the second roller relative to the first roller so as to change a pressure between the second roller and the first roller and a pressure between the second roller and the cleaning member to a predetermined relationship in accordance with a position to which the second roller is driven swingingly, wherein the predetermined relationship according to the position to which the second roller is driven swingingly in such that when the second roller is driven swingingly to a first position on a side of the first roller, the pressure between the second roller and the first roller is a first roller pressure and the pressure between the second roller and the cleaning member is a first cleaning pressure, and when the second roller is driven swingingly to a second position on a side of the cleaning member, the pressure between the second roller and the first roller is a second roller pressure less than the first roller pressure, and the pressure between the second roller and the cleaning member is a second cleaning pressure larger than the first cleaning pressure.

* * * * *